US010814453B2

(12) United States Patent
Skoblenick et al.

(10) Patent No.: US 10,814,453 B2
(45) Date of Patent: Oct. 27, 2020

(54) APPARATUS AND METHOD FOR CORRECTING DAMAGE TO RAILS AND RAILWAY CROSSOVERS

(71) Applicant: Bombardier Transportation GmbH, Berlin (DE)

(72) Inventors: Harry Skoblenick, Kingston (CA); Aleksandar Mancic, Westbrock (CA)

(73) Assignee: Bombardier Transportation GmbH, Berlin (DE)

( * ) Notice: Subject to any disclaimer, the term of this patent is extended or adjusted under 35 U.S.C. 154(b) by 337 days.

(21) Appl. No.: 15/943,814

(22) Filed: Apr. 3, 2018

(65) Prior Publication Data

US 2018/0281144 A1 Oct. 4, 2018

Related U.S. Application Data

(60) Provisional application No. 62/481,384, filed on Apr. 4, 2017.

(51) Int. Cl.

| | |
|---|---|
| ***B24B 19/00*** | (2006.01) |
| ***B24B 23/08*** | (2006.01) |
| ***E01B 31/17*** | (2006.01) |
| ***E01B 31/18*** | (2006.01) |
| ***E01B 7/00*** | (2006.01) |

(52) U.S. Cl.

CPC ..... *B24B 19/004* (2013.01); *B24B 23/08* (2013.01); *E01B 7/00* (2013.01); *E01B 31/17* (2013.01); *E01B 31/18* (2013.01)

(58) Field of Classification Search

CPC ..... B24B 23/08; B24B 19/004; E01B 7/00; E01B 31/17; E01B 31/18

See application file for complete search history.

(56) References Cited

U.S. PATENT DOCUMENTS

| | | | |
|---|---|---|---|
| 1,034,029 | A | 7/1912 | Pellissier |
| 1,933,139 | A | 10/1933 | Daley |
| 3,377,751 | A | 4/1968 | Schnyder |
| 3,708,856 | A | 1/1973 | Keifer |
| 3,818,650 | A | 6/1974 | Behne |
| 4,908,993 | A | 3/1990 | Buhler |
| 5,575,709 | A | 11/1996 | Hertelendi et al. |

(Continued)

FOREIGN PATENT DOCUMENTS

| | | | |
|---|---|---|---|
| CN | 103343497 | A | 10/2013 |
| CN | 103821052 | A | 5/2014 |

(Continued)

*Primary Examiner* — Dung Van Nguyen

(74) *Attorney, Agent, or Firm* — The Webb Law Firm

(57) ABSTRACT

A method of repairing a defect in a damaged rail of a railroad track comprises positioning a rail profiling device on the rails of the railroad track proximate a defect; securing the rail profiling device to the railroad; adjusting its grinder according to a selected value of wheel cone angle to create a profiled running surface over a portion of the damaged rail; creating a median zone using the grinder to remove material from the damaged rail adjacent the defect at a depth corresponding to at least a maximum depth of the defect; creating an incline from the top of the rail and leading to the median zone and one incline leaving the median zone to the top of the rail by using the grinder to grinding material off the damaged rail.

10 Claims, 7 Drawing Sheets

(56) References Cited

U.S. PATENT DOCUMENTS

| | | | | |
|---|---|---|---|---|
| 5,735,734 | A * | 4/1998 | Hertelendi | E01B 31/17 451/347 |
| 6,033,291 | A | 3/2000 | Mathison et al. | |
| 6,663,476 | B1 * | 12/2003 | Story | B24B 19/004 451/347 |
| 6,669,533 | B2 * | 12/2003 | Huboud-Peron | E01B 31/17 451/11 |
| 6,746,307 | B2 | 6/2004 | Knoll et al. | |
| 6,921,319 | B2 | 7/2005 | Knoll et al. | |
| 7,442,115 | B1 * | 10/2008 | Brenny | E01B 31/17 451/65 |
| 8,367,960 | B2 | 2/2013 | Keefe | |
| 9,073,164 | B2 * | 7/2015 | Skoblenick | B24B 19/004 |
| 9,073,167 | B2 * | 7/2015 | Skoblenick | B24B 19/004 |
| 2013/0090041 | A1 | 4/2013 | Skoblenick | |
| 2013/0090046 | A1 | 4/2013 | Skoblenick | |

FOREIGN PATENT DOCUMENTS

| | | | |
|---|---|---|---|
| CN | 105386375 | A | 3/2016 |
| DE | 208891 | | 4/1909 |
| DE | 626511 | | 3/1936 |
| DE | 202007016721 | U1 | 3/2008 |
| EP | 1979543 | B1 | 12/2009 |

* cited by examiner

APPARATUS AND METHOD FOR CORRECTING DAMAGE TO RAILS AND RAILWAY CROSSOVERS

CROSS-REFERENCE TO RELATED APPLICATION

This application claims the benefit of U.S. Provisional Patent Application No. 62/481,384 filed Apr. 4, 2017, the disclosure of which is hereby incorporated in its entirety by reference.

FIELD OF THE INVENTION

The present invention generally relates to the field of railway maintenance. More specifically, the invention relates to an apparatus and a method for correcting damages, such as depressions and corrugated surfaces, to rails and particularly to railway crossovers, especially caused by wheel instability and impacts.

BACKGROUND OF THE INVENTION

The rolling surface profiles found along the length of railway crossovers have been long pre-defined and were intended to provide level conditions for wheel passage. When a rail vehicle passes through a typical steel crossover or 'frog', either of the fixed or moveable point construction, the surface heights and unique shapes of the wheel contacting surfaces of the crossover should ideally support the vehicle wheels and transfer wheel loads with minimal vertical and lateral changes in travel direction.

When the fixed or moveable point steel frogs are initially supplied for transit cross-over installations, the Point-to-Wing profile shape within the turnout castings supplied are often not adequately profiled to fully support the vehicle wheel during passage. As a result, impact forces and rail wear accelerate over the Point-to-Wing transition area and over time lead to the requirement for repair. Typically, such repair is conducted using a weld-and-grind repair action. However, not only does this repair process take a long time (up to 5 hours) during which no train can travel on the track, but the repair results only produce an approximate level running surface over the Point-to-Wing transition area. Hence, although the running surface is brought back near to its as-new condition, it still only approximately matches the vehicle wheel conical profile, still allowing some wheel dipping to occur, resulting in the cycle of rail wear and higher track noise. When frog wear typically reaches between 9 mm and 12 mm (0.35 in to 0.47 in) deep, and when noise levels become unacceptable, the weld repair is applied once more and the cycle starts all over again.

Although crossover frog castings have been supplied for over 100 years and used by every major railway, there has been very little advancement in technology to avoid the acceleration of wheel impact damage over these short transient length depressions other than replacing the casting, rebuilding the local depression by welding, or simply by reducing vehicle speeds.

There is therefore a need for a solution to accelerated damage to rails and crossovers caused by wheel impacts.

SUMMARY OF THE INVENTION

It is an object of the present invention to provide a method of repairing a rail or crossover that overcomes or mitigates one or more disadvantages of known repair methods, or at least provides a useful alternative.

The invention provides the advantage of correcting a damaged fixed or moveable point frog, as well as other rail head damage incurred through normal wear or impact and typically creating a depression on a top surface of the frog or rail, without any prior welding.

Advantageously, the present invention allows the extension of track component life, as well as the mitigation of track areas sensitive to noise and vibration complaints.

In accordance with an embodiment of the present invention, there is provided a rail profiling device for repairing a defect of a damaged rail of a railroad track having two rails. The rail profiling device comprises a frame, two wheel-axle assemblies, a securing mechanism, a slider, and a grinder. Each one of the two wheel-axle assemblies has a pair of first frusto-conical wheels mounted on one axle. Each one of the first frusto-conical wheels has a first cone, or taper, angle. The two wheel-axle assemblies are mounted to the frame. The first frusto-conical wheels are operative to rest, just like a wheel of a rail vehicle, on the rails of the railroad track. The securing mechanism is connected to the frame and is operative to secure the frame to the railroad track. The slider, which is mounted to the frame on a longitudinal side of the frame, can be of various lengths, and at least 2000 mm (78.7 in) long, at least 1500 mm (59.1 in) long, or even at least 1000 mm (39.4 in) long. The grinder is slideably mounted to the slider and is operative to remove material from the damaged rail while moving along the slider.

Preferably, the two wheels-axle assemblies are located at least 1500 mm (59.1 in) apart from each other. More preferably, each one of the first pair of frusto-conical wheels is removable from its respective wheel-axle assembly.

In accordance with another embodiment of the present invention, there is provided a kit for re-profiling a rail. The kit comprises the rail profiling device as described above as well as a second set of four second frusto-conical wheels. The second frusto-conical wheels have a second conical angle different from the first conical angle of the first frusto-conical wheels and are therefore adapted to replace the first frusto-conical wheels on the two wheel-axle assembly.

In accordance with another embodiment of the present invention, there is provided a method of repairing a defect of a damaged rail of a railroad track having two rails. The method of repairing, which uses the rail profiling device described above, comprises:

a) positioning the rail profiling device on the rails or crossover frog of the railroad track proximate the defect;
b) securing the rail profiling device to the railroad. For example, the securing mechanism may be used to secure the rail profiling device to the rails;
c) adjusting the grinder of the rail profiling device according to a selected value of wheel cone angle to create a profiled running surface over a portion of the damaged rail which includes the defect;
d) creating a median zone using the grinder of the rail profiling device to remove material from the damaged rail adjacent the defect at a depth corresponding to at least a maximum depth of the defect with respect to a top running surface of the damaged rail. The median zone should extend substantially parallel to the top running surface of the rail;
e) creating a first incline adjacent the median zone using the grinder to grind the damaged rail starting from a first extremity of the median zone and gradually reaching the top running surface of the damaged rail over a first longitudinal distance ahead of the median zone; and f) creating a second incline adjacent the median zone using the grinder to grind the damaged rail starting from a second extremity of the median zone and gradually reaching the top running surface of the damaged rail over a second longitudinal distance behind the horizontal median zone.

Optionally, the creating the median zone comprises grinding the defect in the damaged rail over at least 200 mm (7.9 in) in length, preferably on both sides of the defect.

The creating the first incline may comprise grinding the damaged rail over the first longitudinal distance by at least 1500 mm (59.1 in). Preferably, the creating the second incline may also comprise grinding the damaged rail over the second longitudinal distance by at least 1500 mm (59.1 in).

The present method may use any variation of the profiling device as well as the kit. In case the kit is used, the method may further comprise replacing the first frusto-conical wheels on the two wheel-axle assembly by the second frusto-conical wheels.

Advantageously, the present repair method is devoid of pre-welding operations before the repair takes place.

BRIEF DESCRIPTION OF THE DRAWINGS

These and other features of the present invention will become more apparent from the following description in which reference is made to the appended drawings wherein.

DESCRIPTION OF THE INVENTION

The present invention relates to a rail profiling device and to a method of using this rail profiling device to repair a damaged rail or frog (whether fixed or moveable) of a railroad track without a prior welding operation. In particular, the present rail profiling device and the associated repair method are used to repair rails and crossover frogs of railroads where the allowed repair time is very low or where welding is not recommended due to the potential for weld-induced stress failures. In the present description, the simple term frog will be used and will be understood to denote either a fixed frog or a moveable point frog, depending on the context. In some context, the term frog could even mean both.

Figure 1:
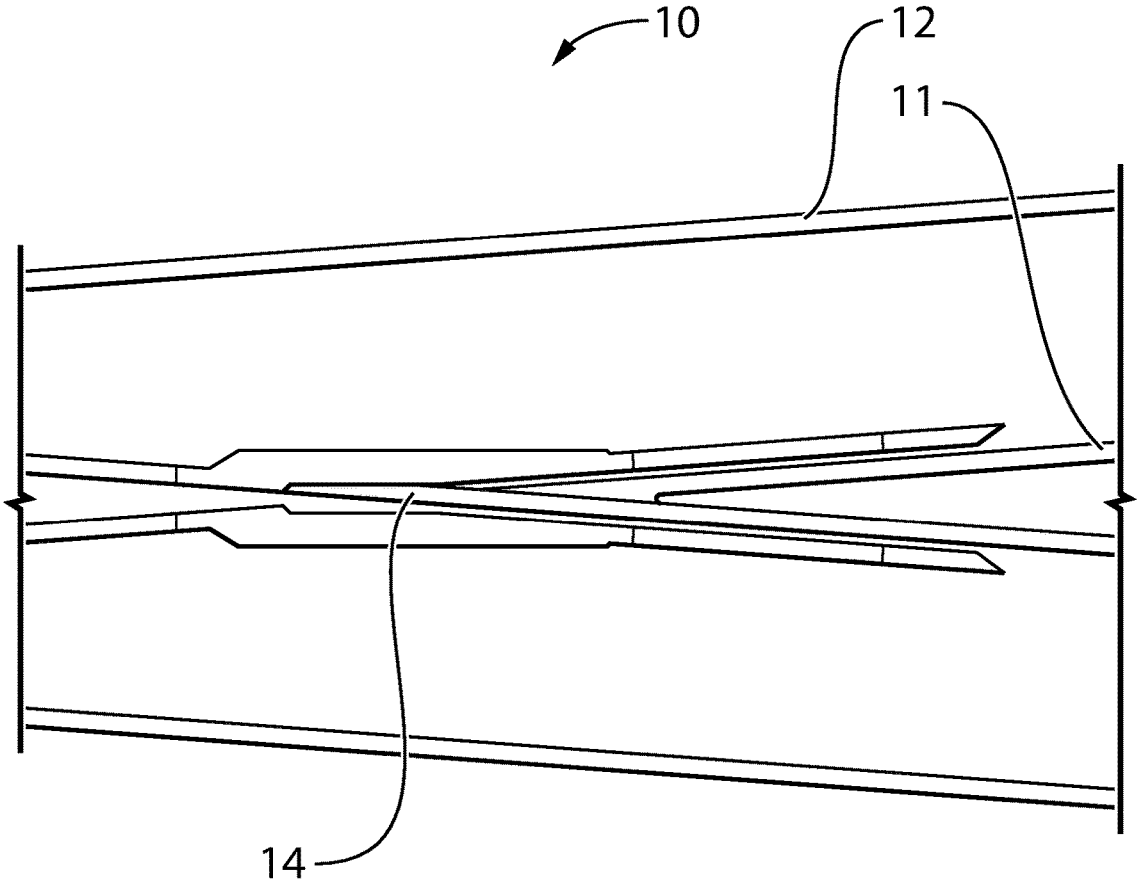
FIG. 1 is a top view of a typical single rail crossing in new condition.
Figure 2:
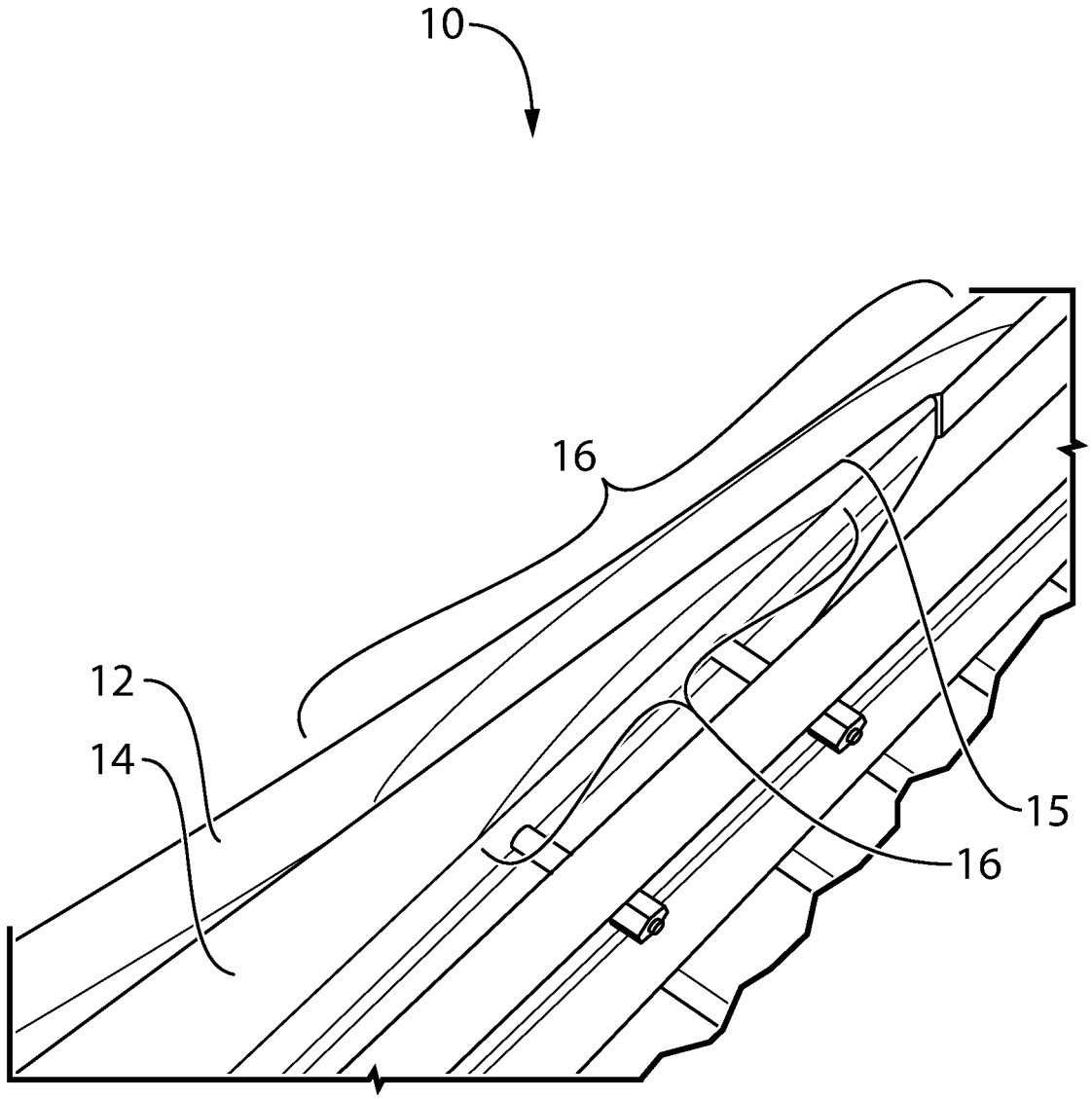
FIG. 2 is an isometric view of a damaged rail and point frog.

FIG. 1, now referred to, shows a crossing 10 of a railroad track 11 in new condition. The crossing 10 uses a frog 14. FIG. 2, now concurrently referred to, shows defects 16 in both a rail 12 and in the frog 14. Such defects 16 are created by the repeated passage and impacts of the wheels of rail vehicles at the point-to-wing area 15 (the junction where the wheels of a rail vehicle transfer from the rail 12 to the frog 14), the impacts themselves being the result of an uneven transfer of the wheels between the frog 14 and the rail 12 (and vice-versa, depending on the direction the rail vehicle travels). Such defects 16 are depressions in the surface of the rail 12, that can reach a considerable depth (in the order of 10 mm, or 0.4 in) below a top rolling surface of the rail.

Figure 3:
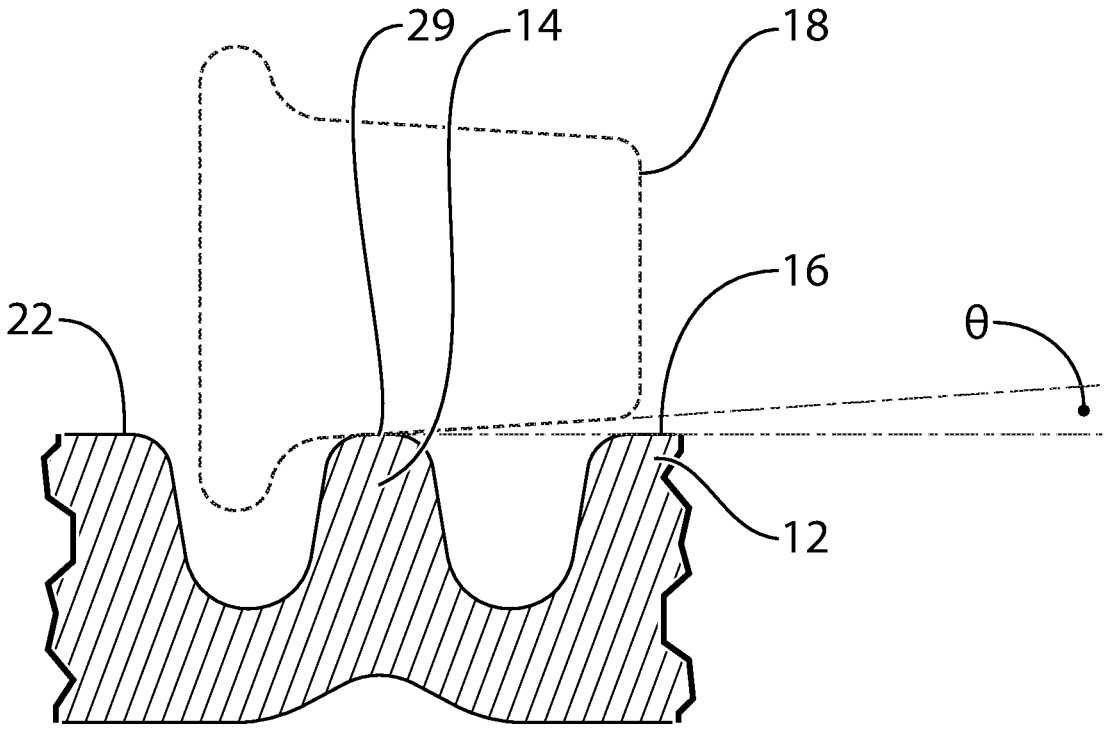
FIG. 3 is a cross-sectional view of a tapered wheel rolling over a fixed point frog of a crossing and about to roll on an adjacent damaged rail.

FIG. 3, now concurrently referred to, shows a cross section of a fixed crossing showing a wheel 18 rolling over a frog 14 (fixed in the present case) and about to transition on the rail 12, which has a defect 16. At that point, both the frog 14 and the rail 12 should support the wheel 18. However, as can be seen, defect 16 creates a void below the wheel 18. Once the support from the frog 14 ceases, the wheel 18 drops on the defect 16, creating even more damage.

Figure 4A:
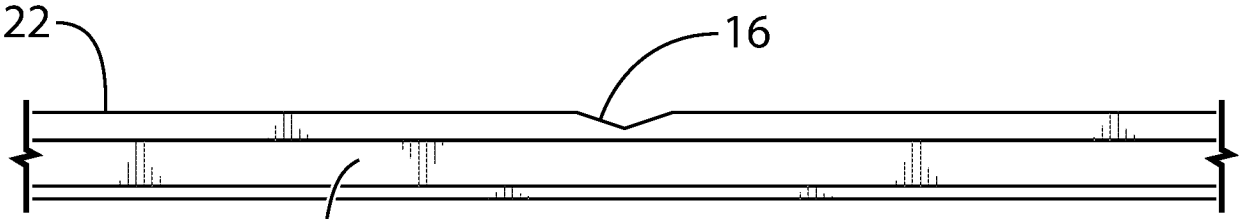
FIG. 4*a* is a side view of a damaged rail.
Figure 4B:
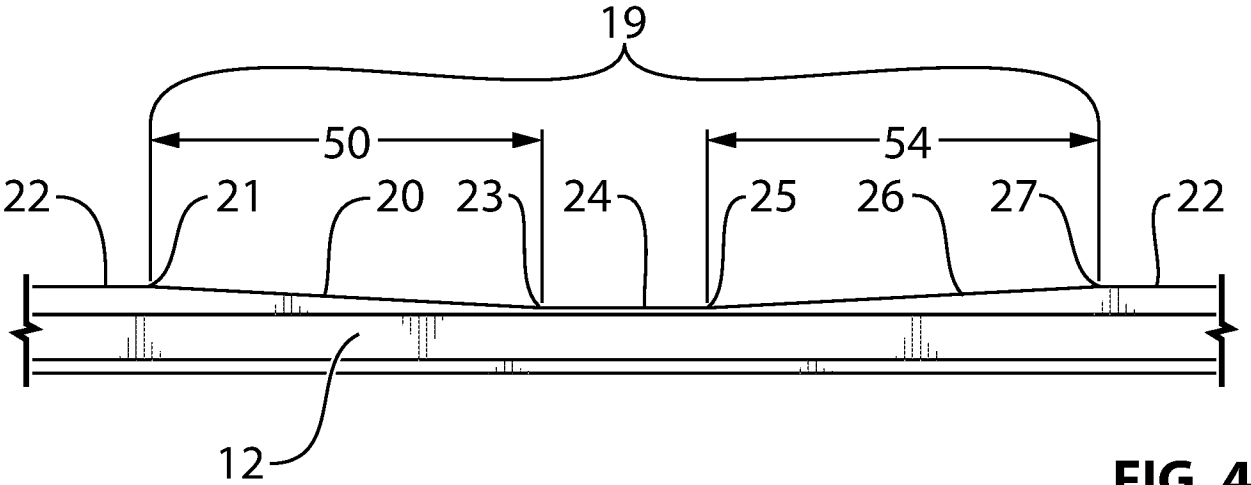
FIG. 4*b* is a side view of the damaged rail of FIG. 4*a* once repaired in accordance with an embodiment of the present invention.

FIGS. 4*a* and 4*b* are now concurrently referred to. The original defect 16 is represented in FIG. 4*a* while its repair 19 is represented in FIG. 4*b*. The present repair method provides a controlled linear re-profiling of the defect 16 that effectively stretches or 'blends-out' the localized defect 16 in the worn rail 12 or worn frog 14 and accurately re-profiles its head to better match a conical shape of the wheels 18 of a rail vehicle. In other words, rather than rebuilding the defect 16 using welding, which typically requires rebuilding an area in the order of 600 mm (23.6 in) long, the defect 16 (which is a depression in the top of the rail 12) is rather stretched out progressively to approximately 3400 mm (133.9 in) in length.

The repair 19 comprises 3 portions: a leading incline 20, a median zone 24, and a leaving incline 26. Along the rail 12, the leading incline 20 starts at a first point 21, located at a top running surface 22 (corresponding to the top of the rail 12), and leads gradually downwardly to second point 23 at the start of the median zone 24. The median zone 24 extends horizontally substantially at a constant depth relative to the top running surface 22 up to third point 25. This depth corresponds substantially to the depth of the original defect 16, or maybe even a bit more. The leaving incline 26 extends from the third point 25 at the end of the median zone 24 and gradually leads upwardly to fourth point 27 vertically located at top running surface 22. Although typically rectilinear (in a vertical plane along the rail 12), both the leading incline 20 and the leaving incline 26 could also adopt a curvilinear profile. The transitions between the leading incline 20 and the median zone 24 as well as between the median zone 24 and the leaving incline 26 may be rounded to assure a smooth transition between these three portions. The same may be done with the transition between an undamaged portion of the rail 12 and both the leading incline 20 and the leaving incline 26. In fact, the whole sequence leading incline 20, median zone 24 and leaving incline 26 could be smoothed out to the point where they blend into each other as a series of tangent curves, which could also be tangent at first point 21 and fourth point 27.

Figure 5:
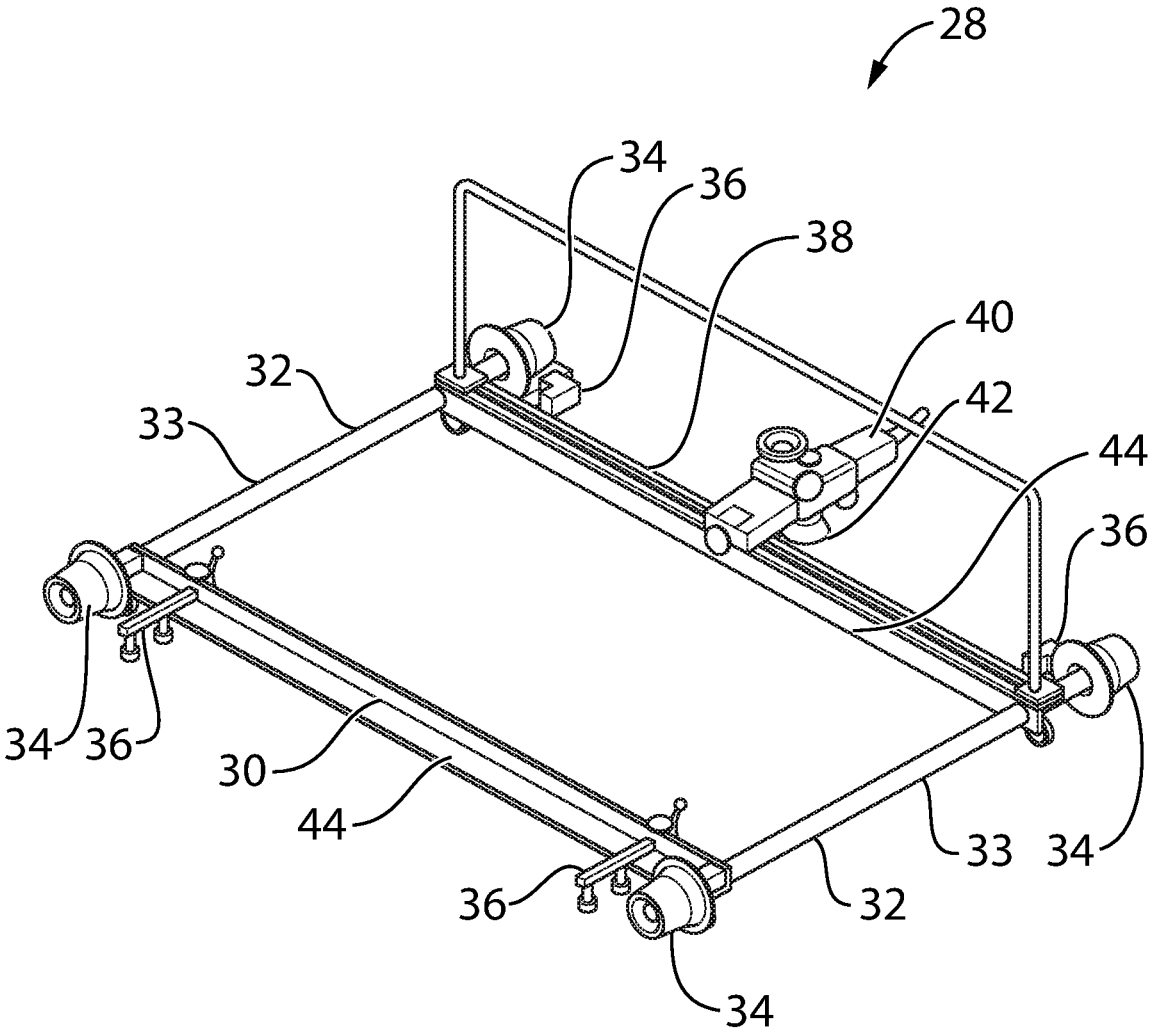
FIG. 5 is an isometric view of a linear profiling device in accordance with an embodiment of the present invention.
Figure 6:
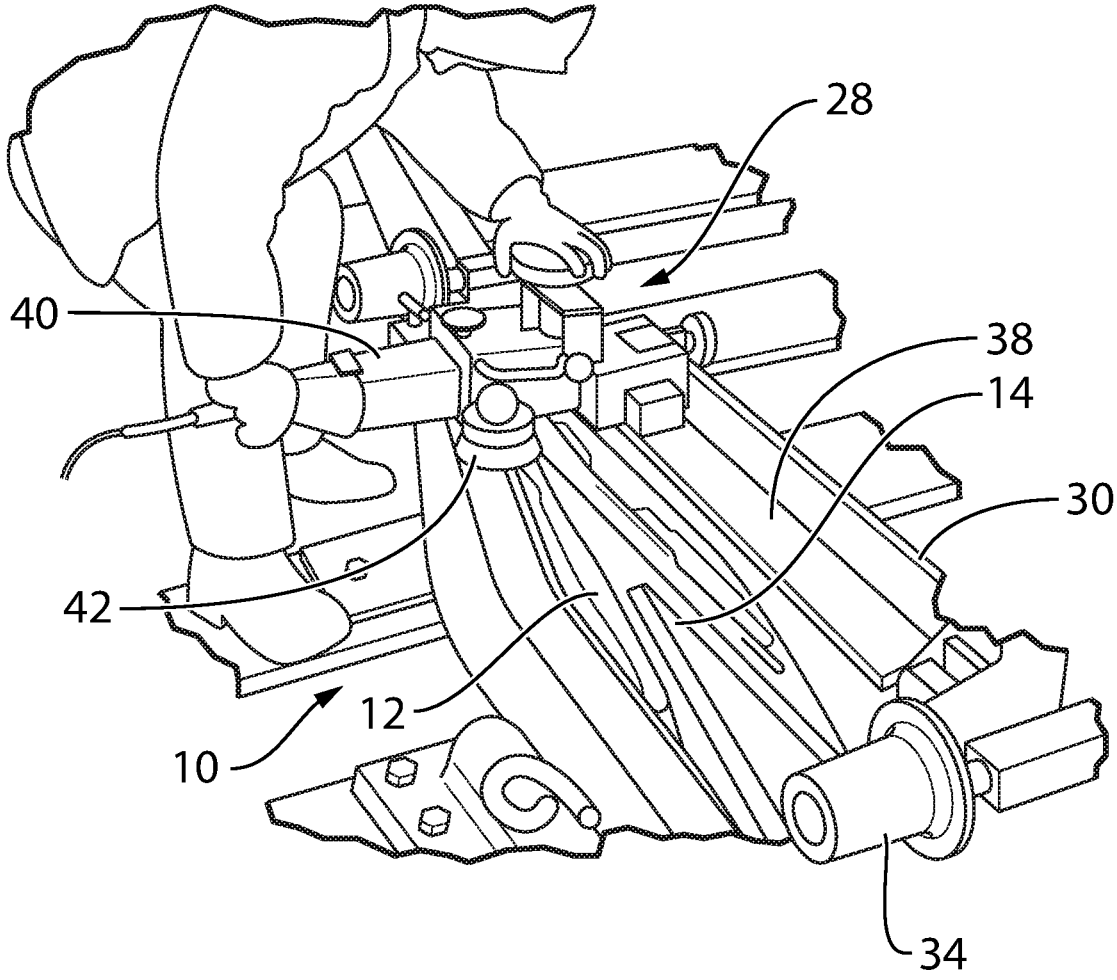
FIG. 6 is an isometric view of a track worker applying using the linear profiling device of FIG. 5 on the damaged crossing.

In a transversal plane, the shape of a head 29 of the leading incline 20, the leaving incline 26 and of the median zone 24 is determined by grinding accurately a top portion of these portions of the rail 12 to match the taper of the wheel 18 of a rail vehicle circulating on the rail 12 or frog 14. The shape of this head 29 is readily determined by North America and International railway standards (AREMA and UIC for example) and may only be accurately ground by using a high precision rail profiling device 28, best shown in FIGS. 5 and 6, now concurrently referred to.

The rail profiling device 28, which may be used for re-profiling the rail 12 or the frog 14 of the railroad track 11, comprises a frame 30, two wheel-axle assemblies 32 (each having an axle 33 and a pair of frusto-conical wheels 34), a securing mechanism 36, a slider 38 and a grinder 40. The grinder itself is equipped with a replaceable grinding stone 42.

The securing mechanism 36 is designed to removably, but solidly, secure the frame 30 to the railroad track 11. This allows precise grinding of the rail 12 or frog 14. The slider 38, which is connected to a longitudinal side 44 of the frame 30, is at least 1000 mm (39.4 in) long, and may even be at least 2000 mm (78.7 in) long. The grinder 40 connected to the slider 38 may freely move along the full length of the slider 38, on the longitudinal side 44 of the frame 30 and aligned with the rail 12, so as to remove material from the rail 12 and create the median zone 24, the leading incline 20 and the leaving incline 26.

The grinder 40 is designed to be accurately adjusted to a pre-determined grinding angle with +/−0.2 degree accuracy using a digital calibration level. The grinding stone 42 allows providing at least 100 mm (3.9 in) wide flat cut to the frog 14 and wing surfaces of the rail 12 in a single pass over the full length of the frog 14.

The two wheel-axle assemblies 32 are connected to the frame 30 so that the frusto-conical wheels 34 may spin on the axle 33 and roll along the rails 12. Alternatively, the wheels 34 may be solidly attached to the wheel-axle assemblies 32 and the wheel-axle assemblies 32 may spin in bearings attached to the frame 30. In other words, the axle 33 may spin with the wheels 34 or not, but this is merely a design choice. Also, the wheels 34 may be removably connected to the axles 33 so that they can be easily interchanged for other wheels 34 which have a different taper (or conical) angle θ, best shown in FIG. 3. For example, the wheels 34 may have a 200 mm (7.9 in) diameter and have the same wheel profile and tread spacing as vehicle wheels 18. Indeed, for a precise grinding operation to take place, it is preferable that the conical angle θ of the wheels 34 be the same as that of the wheels 18 of rail vehicles travelling on that specific rail 12 to be grinded.

Hence, it is convenient to provide the rail profiling device 28 as a kit comprising many sets of interchangeable wheels 34 having different conical angles θ as the wheels with the appropriate conical angle may be selected and installed on the rail profiling device 28 prior to the grinding operation of the repair method.

Figure 7:
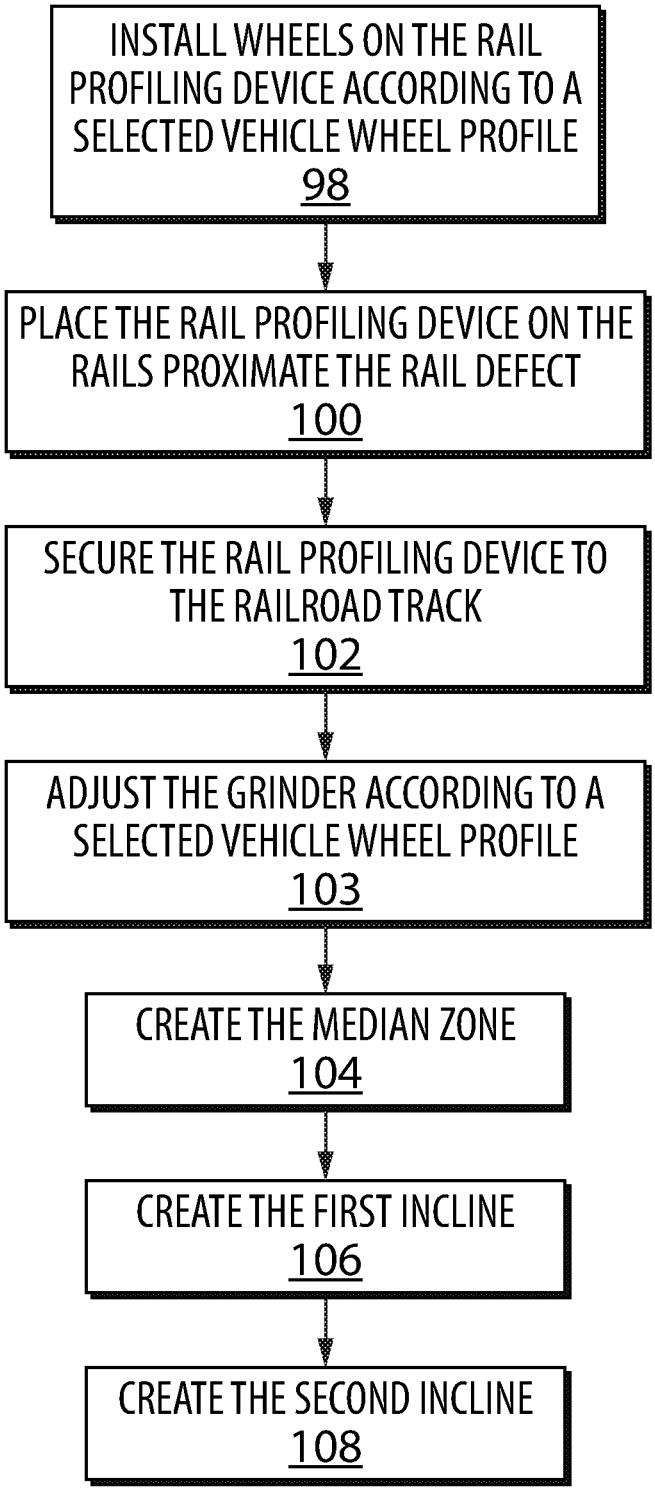
FIG. 7 is a schematic of the steps of a repair method in accordance with an embodiment of the present invention.

FIG. 7, now concurrently referred to, schematically represents the method of repairing the rail 12 or the frog 14 of the railroad track 11 using the rail profiling device 28. An important advantage of the present method is that the damaged rail 12 or crossover frog 14 may be repaired without having recourse to pre-welding operations, as is often necessary with prior repair methods.

According to the present method, at step 98, the right conical angle θ of the frusto-conical wheels 34 of the rail profiling device 28 is first determined based on the own profile (conical angle) of vehicle wheels 18. Once this is determined, the right set of frusto-conical wheels 34 are selected and installed on the rail profiling device 28.

The rail profiling device 28 is then positioned over the defect 16 at step 100. Advantageously, the rail profiling device 28 may be rolled on the track 11 up to this location since it is equipped with frusto-conical wheels 34 adapted to roll on rails 12. The rail profiling device 28 shall be positioned so that it is possible, through the travel of the grinder 40 on the slider 38, to reach the defect 16 and to create the horizontal median zone 24 as explained below. Note that steps 98 and steps 100 could be inverted and that the right set of frusto-conical wheels 34 could be installed on the rail profiling device 28 once it is placed over the defect 16. However, it is much more convenient to determine the right set of frusto-conical wheels 34 and to install them before the rail profiling device 28 is moved into place over the defect 16.

At step 102, the rail profiling device 28 is solidly secured to the railroad using the securing mechanism 36 so that later grinding operation may be conducted accurately. For example, the rail profiling device 28 may be secured to the rail 12. At 104, the median zone 24 is created.

At step 103, the grinder 40 is adjusted to reproduce a selected head profile of the running surface of the rail 12 that will be adequate to match the selected wheel taper angle or wheel profile of the vehicle wheels 18 that typically travel on the rail 12. When different wheel taper angles or wheel profiles travel on the rail 12, an intermediate angle value may be selected for adjusting the grinder 40. Similarly, a best-fit intermediate profile of frusto-conical wheels 34 would be used.

Unless a very small quantity of material needs to be removed from the rail 12, it is rarely the case that all this material may be ground in only one pass, simply because the grinding stone 42 and the grinder 40 are not capable of grinding so much material at once. Hence, in most repairs, many passes need to be made to remove the required material with the grinder 40 set at one given angle. Moreover, to produce the selected head profile, it may be necessary to adjust the grinder 40 at different angles. Indeed, this is necessary because the grinding stone 42 of the grinder 40 produces a longitudinal flat surface on the rail 12 or frog 14, and because the head profile has a curved profile. Therefore, typically, the grinder 40 needs to be set at two different angles during the repair to the frog 14, and from at least 3 to 5 different angles to repair the rail 12, depending on the wheel taper and the existing rail head condition. The resulting head profile of the rail 12 or frog 14 is therefore made of a plurality of straight segments approximating the selected head profile and resulting from the many passes of the grinder 40 at different angles. The more different grinder angles are used during a grinding operation, the more accurate the resulting head profile. Such angle adjustment of the grinder 40 and the repeated passes are necessary at each one of the grinding steps 104, 106 and 108 described hereafter. For ease of reading, a single pass of the grinder 40 is described, but it should be understood that repeated passes at different angles are usually required to produce the selected head profile.

Step 104 comprises using the rail profiling device 28 to remove material on both sides of the deepest portion of the defect 16 to create the median zone 24 at a depth corresponding at least to this maximum depth of the defect 16. This maximum depth of the defect 16 is measured with respect to the top running surface 22 of the rail 12. The median zone 24 extends substantially horizontally and parallel to the top running surface 22 of the rail 12. Optionally, the horizontal median zone 24 may be at least 100 mm (3.9 in) in length and potentially at least 200 mm (7.9 in) in length.

At step 106, a first incline is created. This first incline corresponds to the leading incline 20 as shown in FIG. 4*b*. Alternatively, the first incline could also correspond to the leaving incline 26 as it does not matter which incline is made first. For the sake of illustrating the present method, it will nevertheless be considered that step 104, where the first incline is produced, corresponds to producing the leading incline 20.

The step of creating the first incline 106 comprises using the rail profiling device 28 to create the leading incline 20 by removing material from the rail 12, starting from a first extremity of the median zone 24 at the second point 23 and gradually reaching the top running surface 22 of the rail 12 at the first point 21. The leading incline 20 extends over a first longitudinal distance 50 ahead of the median zone 24.

At step 108, the second incline is created. Consistently with the present example of the present method, the second incline corresponds to the leaving incline 26. It is understood that if the first incline would have corresponded to the leaving incline 26, then the second incline would have consequently corresponded to the leading incline 20. In accordance with the present example of the method, step 108 therefore corresponds with manufacturing the leaving incline 26. Similarly to the step of creating the first incline 106, the step of creating the second incline 108 comprises using the rail profiling device 28 to remove material from the rail 12, starting from a second extremity of the median zone 24 at the third point 25 and gradually reaching, over a second longitudinal distance 54 behind the median zone 24, the top running surface 22 at fourth point 27.

The first longitudinal distance 50 and the second longitudinal distance 54 over which are ground respectively the leading incline 20 and the leaving incline 26 may be at least 500 mm (19.7 in), at least 1000 mm (39.4 in) or even at least 1500 mm (59 in). If the slider 38 of the rail profiling device 28 is even longer, such as 1600 mm (63 in) and more for example, the leading and the leaving inclines 20, 26, may be made longer as well. The longest the first longitudinal distance 50 of the leading incline 20, the smoothest the transition between the first point 21, located at the same height as the top running surface 22, and the median zone 24, located at the greatest vertical distance from (or largest depth below) the top running surface 22. Similarly, the longest the second longitudinal distance 54 of the leaving incline 26, the smoothest the transition between the median zone 24 and the fourth point 27, located at the same height as the top running surface 22.

Although it is apparent that the leading and the leaving inclines 20, 26 are not exactly the same length as that of the first and the second longitudinal distances 50, 54, (the leading and leaving inclines 20, 26 correspond to the hypotenuses of right triangles whose adjacent sides are respectively the longitudinal distances 50, 54 and the opposed sides are respectively the distances of the second point 23 and of the third point 25 to the top running surface 22. It will however be appreciated that the longitudinal distances 50, 54 are very close to the length of the inclines 20, 26 because the depth of the defect 16 is never much more than 10 mm (0.4 in). This vertical distance, being very small with respect to the longitudinal distances 50, 54, means that there is only a minute difference between the longitudinal distances 50, 54 and the length of the respective leading and leaving inclines 20, 26. For example, a longitudinal distance 50 of 1600 mm (63 in) and a defect depth of 10 mm (0.4 in) will yield an non-significant difference of 0.002% between the longitudinal distances 50, 54 and the length of the respective inclines 20, 26.

Using the present repair method of controlled linear re-profiling of rail surfaces with a suitable wheel profile leading into and out of the defect 16, a local defect or depression in the rail 12 is in fact stretched in length by a factor of approximately 30 times, providing an impact and noise reduced rail and frog repair without prior welding of the defect 16.

The following represent measurements results that, although representative of the order of magnitude, should not be considered as precisely reproducible. Measurements have shown that when a vehicle travels at 65 kph (40.4 mph) over a 600 mm (23.6 in)×10 mm (4 in) deep depression, as depicted by the defect 16 of FIG. 4*a*, an impact of 14.5 G is produced on the rail 12 with a resulting impact noise of up to 100 dBa. When the same depression is re-profiled to be spread over a 3400 mm (133.9 in) long rail section in accordance with the repair method of the present invention, the resulting impact and rail noise are dramatically respectively reduced to an acceptable level of 0.5 G and 76 dBa.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

What is claimed is:

1. A method of repairing a defect of a damaged rail of a railroad track having two rails, the method of repairing using a rail profiling device having a grinder, the method comprising:

positioning the rail profiling device on the rails proximate the defect;

securing the rail profiling device to the railroad;

adjusting a grinder of the rail profiling device according to a selected value of wheel cone angle to create a profiled running surface over a portion of the damaged rail;

creating a median zone, said creating the median zone comprising using the grinder of the rail profiling device to remove material from the damaged rail adjacent the defect at a depth corresponding to at least a maximum depth of the defect with respect to a top running surface of the damaged rail, said median zone extending substantially parallel to the top running surface of the rail;

creating a first incline, said creating the first incline comprising using the grinder to grind the damaged rail starting from a first extremity of said median zone and gradually reaching the top running surface of the damaged rail over a first longitudinal distance ahead of said median zone; and creating a second incline, said creating the second incline comprising using the grinder to grind the damaged rail starting from a second extremity of the median zone and gradually reaching the top running surface of the damaged rail over a second longitudinal distance behind said median zone.

2. The method of claim 1 wherein said creating the median zone comprises grinding said damaged rail over at least 200 mm (7.9 in) in length.

3. The method of claim 2 wherein said creating the first incline comprises grinding the damaged rail over said first longitudinal distance of at least 1500 mm (59.1 in).

4. The method of claim 3 wherein said creating the second incline comprises grinding the damaged rail over said second longitudinal distance of at least 1500 mm (59.1 in).

5. The method of claim 1 using the rail profiling device for repairing a defect on a damaged rail of a railroad track having two rails, the rail profiling device comprising:

a frame;

two wheel-axle assemblies, each one of said two wheel-axle assemblies having a pair of first frusto-conical wheels mounted on one axle, each one of said first frusto-conical wheels having a first cone angle, said two wheel-axle assemblies being mounted to said frame, said first frusto-conical wheels being operative to rest on the rails of the railroad track;

a securing mechanism, said securing mechanism being connected to said frame and being operative to secure said frame to the railroad track;

a slider, said slider being mounted to said frame on a longitudinal side of said frame, said slider being at least 1000 mm (39.3 in) long; and a grinder, said grinder being slideably mounted to said slider, said grinder being operative to remove material from the damaged rail while moving along said slider.

6. The method of claim 1 wherein said slider is at least 1500 mm (59.1 in) long.

7. The method of claim 1 wherein each one of said first pair of frusto-conical wheels is removable from its respective one of said two wheel-axle assemblies.

8. The method of claim 1 using a kit for re-profiling a rail, the kit comprising:

a rail profiling device comprising:

a frame;

two wheel-axle assemblies, each one of said two wheel-axle assemblies having a pair of first frusto-conical wheels mounted on one axle, each one of said first frusto-conical wheels having a first cone angle, said two wheel-axle assemblies being mounted to said frame, said first frusto-conical wheels being operative to rest on the rails of the railroad track, wherein each one of said first pair of frusto-conical wheels is removable from its respective one of said two wheel-axle assemblies;

a securing mechanism, said securing mechanism being connected to said frame and being operative to secure said frame to the railroad track;

a slider, said slider being mounted to said frame on a longitudinal side of said frame, said slider being at least 1000 mm (39.3 in) long;

a grinder, said grinder being slideably mounted to said slider, said grinder being operative to remove material from the damaged rail while moving along said slider; and two pairs of second frusto-conical wheels, each one of said second frusto-conical wheels having a second conical angle, each one of said second frusto-conical wheels being adapted to replace a respective one of said first frusto-conical wheels on said two wheel-axle assembly.

9. The method of claim 8 further comprising replacing the first frusto-conical wheels on each of the two wheel-axle assemblies by the second frusto-conical wheels.

10. The method of claim 1 being devoid of a pre-welding operation.

* * * * *